United States Patent [19]

Cheetham

[11] Patent Number: 4,700,914

[45] Date of Patent: Oct. 20, 1987

[54] ONE LEGGED STOOL

[75] Inventor: Donald O. Cheetham, Pershore, United Kingdom

[73] Assignee: G&C Home & Leisure Supplies Limited, Pershore, United Kingdom

[21] Appl. No.: 830,869

[22] Filed: Feb. 19, 1986

[30] Foreign Application Priority Data

Feb. 19, 1985 [GB] United Kingdom ..... 8504182

[51] Int. Cl.[4] ..... A45D 19/04

[52] U.S. Cl. ..... 248/155.1; 108/150

[58] Field of Search ..... 248/155.1, 155, 155.2, 248/155.3, 156, 371; 108/150; 297/195, 115

[56] References Cited

U.S. PATENT DOCUMENTS

| | | | |
|---|---|---|---|
| 787,166 | 4/1905 | Garden | 248/155.1 |
| 3,817,483 | 6/1974 | Garvey | 248/155 |
| 3,912,209 | 10/1975 | Turpin | 248/155.1 |
| 4,098,478 | 7/1978 | Spitzke | 108/150 X |
| 4,101,163 | 7/1978 | Morin | 248/155.5 X |
| 4,183,579 | 1/1980 | Gonzalez Y. Rojas | 297/195 |
| 4,232,896 | 11/1980 | Caldwell | 108/150 X |

FOREIGN PATENT DOCUMENTS

| | | |
|---|---|---|
| 0343465 | 2/1931 | United Kingdom . |
| 0473751 | 10/1937 | United Kingdom . |
| 0625457 | 6/1949 | United Kingdom . |
| 0925123 | 5/1963 | United Kingdom . |

*Primary Examiner*—Ramon O. Ramirez

*Attorney, Agent, or Firm*—Young & Thompson

[57] ABSTRACT

A stool has a saddle-like seat (1) pivotally mounted at the top of a tubular leg (2). A catch can hold the seat horizontal or vertical, and in the latter position a slot (3) in the seat provides a carrying handle (4). The catch is a spring-loaded plunger (7) housed in the upper end of the leg (2) and retained by the pivot pin (11) which extends through a slot in the plunger. The plunger is engageable in holes (5, 13) in the seat and a boss (8) beneath the seat and can be released by pressing its exposed end.

7 Claims, 8 Drawing Figures

ONE LEGGED STOOL

This invention relates to seats and is concerned with portable, lightweight folding stools having some resemblance to shooting sticks.

Conventionally, shooting sticks have two hinged U-members at the upper end with a leather web suspended between the bases of the U-members, which fold up butterfly fashion. They also generally have a spike at the lower end, and a screw-on or hinged disc for limiting penetration into soft ground. Altogether, they are quite refined pieces of equipment and, with the materials normally used, fairly expensive. They are seldom very comfortable and have a pronounced 'up-market' image.

It is the aim of this invention to provide an equivalent device of simpler construction and greater comfort.

According to the present invention there is provided a stool having a leg and a saddle-like seat at its upper end, the seat being pivotable between generally horizontal and vertical attitudes when the leg is upright, and a spring-loaded plunger in the upper end of the leg, the seat having a detent to receive the plunger when horizontal and thereby be retained in that attitude.

Preferably, the detent is a hole and the plunger is disengageable by pressing its end exposed in the hole.

The seat conveniently has a recessed boss underneath to embrace the upper end of the leg and through which a pivot pin extends This boss may also have a detent to receive the plunger when the seat is vertical, thereby to retain it in that attitude. This detent too may be a hole, the plunger being disengageable by pressing its end exposed in the hole.

Conveniently, the plunger is retained by a pivot pin for the seat extending through a slot in the plunger.

The seat will preferably be generally isoscales triangular in plan and pivot about an axis parallel to the base thereof, the apex of the seat being downwards in the vertical attitude. The seat may have a slot near the base of the triangle providing a carrying handle.

Normally the seat will be a unitary moulding of plastics material, and the leg will be tubular.

For a better understanding of the invention, one embodiment will now be described, by way of example, with reference to the accompanying drawing, in which.

Figure 1:
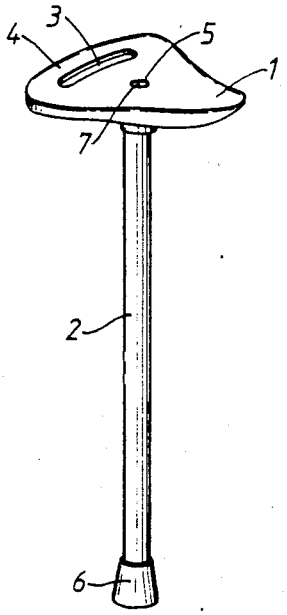
FIG. 1 is a perspective view of a portable stool.
Figure 2:
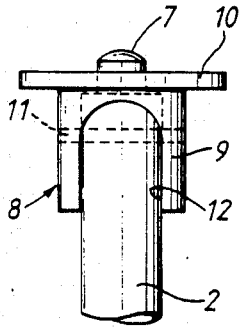
FIG. 2 is a front elevation of a seat support boss.
Figure 3:
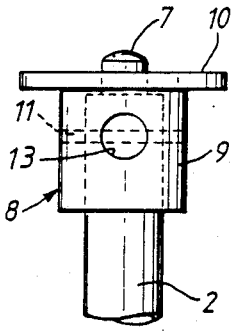
FIG. 3 is a rear elevation of the boss.

The stool of FIG. 1 has a seat 1 in the form of a saddle mounted at the top of a single leg 2. The seat is of moulded plastics construction and is formed with a slot 3 across the wider, rear end which provides a carrying handle 4. At the centre, aligned with the leg 2, there is a hole 5.

The leg 2 is conveniently a metal tube fitted with a rubber or plastics ferrule 6 at its lower end. At its upper end, it houses a spring loaded plunger 7 which enters the hole 5 when the seat is in the FIG. 1 position, its slightly domed upper end being flush with, or just below, the surface of the seat.

Figure 4:
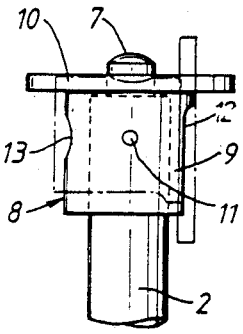
FIG. 4 is a side elevation of the boss.
Figure 5:
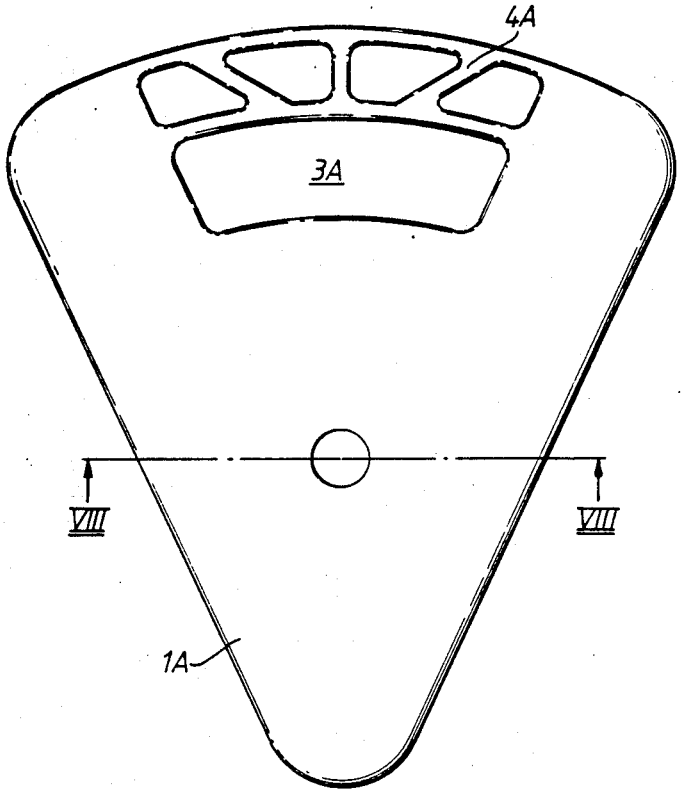
FIG. 5 is a plan view of an alternative seat.
Figure 8:
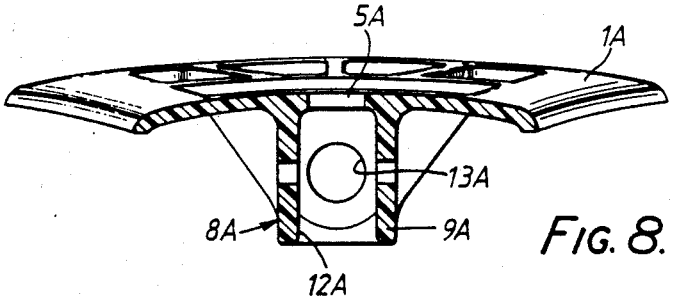
FIG. 8 is a cross section of the seat on the line VIII—VIII of FIG. 5.
Figure 6:
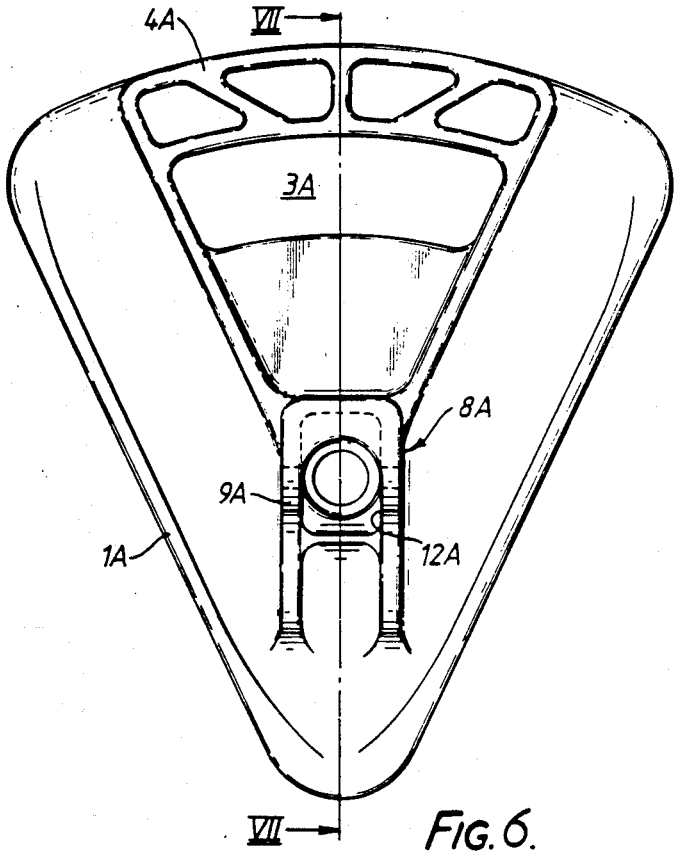
FIG. 6 is an underneath plan view of the seat of FIG. 5.
Figure 7:
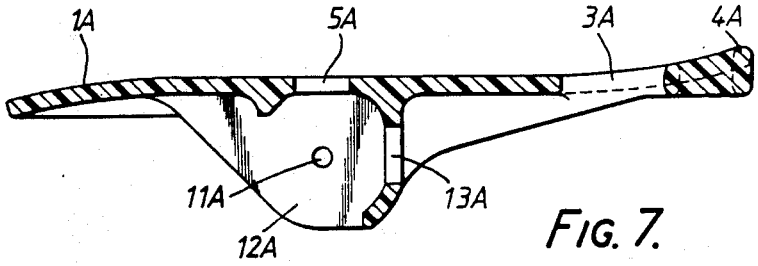
FIG. 7 is a longitudinal section of the seat on the line VII—VII of FIG. 5.

The seat 1 is pivotally mounted to the upper end of the leg 2 by means of a boss 8. This is of generally cylindrical form with a main body 9 and an upper flange 10 to which the seat is secured. A pivot pin 11 extends through the leg 2 and into the body 9 at each side. It will also pass through a slot in the plunger 7, acting as a retaining device for that plunger while allowing it the necessary vertical movement. The body has a U-shaped cut-out 12, open to the lower end, in its forward side, and a hole 13 in its rear side, the centre of the hole, the pivot axis and the centre of curvature of the upper end of the cut-out being co-planar. This allows the seat 1 to tilt forwards, once the plunger 7 has been pressed down below the hole 5, to the dotted line position shown in FIG. 4. When it reaches that attitude, the plunger 7 will spring back up into the hole 13 and thus lock the seat in a carrying position with the handle 4 uppermost. Pressing the plunger down again allows the seat to be tilted back to the horizontal position.

It will be understood that other catch devices may be employed, for example mounted on the leg below the boss and positively engaging the latter in both set positions. This would remove the need for the hole 5.

Although shown attached to the top of the flange 10, it is envisaged that the seat may be moulded on to the boss, which would thus be partially concealed, or it may be possible with some plastics materials to make the seat and boss integrally. Such a seat is shown in FIGS. 5 to 8, where equivalent parts have corresponding references but with the suffix A.

It will be understood that, as well as providing a lightweight portable seat, it can also serve as a walking stick when the saddle is tilted to the vertical position.

I claim:

1. A stool having a leg and a saddle-like seat at its upper end, the seat having a recessed boss underneath to embrace the upper end of the leg and through which a pivot pin extends, the seat being pivotable between generally horizontal and vertical attitudes when the leg is upright, and a spring-loaded plunger in the upper end of the leg, the seat having a detent to receive the plunger when horizontal and thereby be retained in that attitude, and the boss having a hole to receive the plunger when the seat is vertical, thereby to retain it in that attitude, the plunger being disengageable by pressing its end exposed in this hole.

2. A stool as claimed in claim 1 wherein the plunger is retained by the pivot pin extending through a slot in the plunger.

3. A stool as claimed in claim 1, wherein the seat is generally isosceles triangular in plan and pivots about an axis parallel to the base thereof, the apex of the seat being downwards in the vertical attitude.

4. A stool as claimed in claim 3, wherein the seat has a slot near the base of the triangle providing a carrying handle.

5. A stool as claimed in claim 1, wherein the seat is a unitary moulding of plastics material.

6. A stool as claimed in claim 1, wherein the leg is tubular.

7. A stool as claimed in claim 1, wherein the detent is a hole and the plunger is disengageable by pressing its end exposed in this hole.

* * * * *